US007152252B2

(12) United States Patent
Gellis et al.

(10) Patent No.: US 7,152,252 B2
(45) Date of Patent: Dec. 26, 2006

(54) CONVERTIBLE FACE AND HEAD COVERING

(75) Inventors: David Gellis, Stowe, VT (US); Gad Shaanan, La Jolla (CA); Francois Duval, Terrebonne (CA); Serge Debeau, Laval (CA); Ivan Brousseau, Montreal (CA)

(73) Assignee: Gordini U.S.A. Inc., Essex Jct., VT (US)

( * ) Notice: Subject to any disclaimer, the term of this patent is extended or adjusted under 35 U.S.C. 154(b) by 272 days.

(21) Appl. No.: 10/948,102

(22) Filed: Sep. 23, 2004

(65) Prior Publication Data

US 2006/0085881 A1 Apr. 27, 2006

Related U.S. Application Data

(60) Provisional application No. 60/579,907, filed on Jun. 15, 2004, provisional application No. 60/505,086, filed on Sep. 23, 2003.

(51) Int. Cl.
*A42B 3/18* (2006.01)

(52) U.S. Cl. ..... 2/206; 2/202; 2/203; 2/204; 2/209.11; 2/171; 2/172; 2/173; 2/410; 2/9; 2/468; 2/425; 2/423; 2/424; 206/213; 206/278; 206/8

(58) Field of Classification Search ..... 2/206, 2/410, 202, 203, 204, 209.11, 171, 173, 423, 2/424, 172, 9, 468, 425; 206/213, 278, 8
See application file for complete search history.

(56) References Cited

U.S. PATENT DOCUMENTS

| | | | | |
|---|---|---|---|---|
| D369,442 | S * | 4/1996 | Jones | D29/108 |
| 5,822,800 | A * | 10/1998 | Anderson | 2/202 |
| 6,665,878 | B1 * | 12/2003 | Way | 2/84 |
| 7,028,345 | B1 * | 4/2006 | Waldman | 2/468 |
| 2005/0160514 | A1 * | 7/2005 | Flaniken | 2/84 |

* cited by examiner

*Primary Examiner*—Gary L. Welch
*Assistant Examiner*—Alissa J. Tompkins
(74) *Attorney, Agent, or Firm*—Peter D. Aufrichtig; Aufrichtig, Stein & Aufrichtig, P.C.

(57) ABSTRACT

An enhanced mask system including a mask portion, for covering the nose, mouth and lower face of a wearer. The mask portion has an inner surface for being closer to the wearer and an outer surface for being further from the wearer. A head covering or balaclava is secured to the mask portion and a pocket secured to the inner surface of the mask portion removably contains the head covering or balaclava when in its secured position. The mask can be worn by the wearer either with the head covering or balaclava on the wearer's head in a deployed position or without the head covering or balaclava on the wearer's head and stowed in the pocket in the secured position.

15 Claims, 8 Drawing Sheets

CONVERTIBLE FACE AND HEAD COVERING

This application claims the priority of prior application Ser. No. 60/505,086 filed on Sep. 23, 2003 and prior application Ser. No. 60/579,907 filed on Jun. 15, 2004.

BACKGROUND OF THE INVENTION

The invention is generally directed to an article of clothing intended to be worn on the head of a person in cold and windy weather and, in particular, to cover the neck, face and possibly the top of the wearer's head. In the past, there have been various cold and inclement weather devices such as masks developed to protect the wearer's face. Many of these have been in the form of a mask or a mask and a scarf designed to cover the lower portion of the wearer's face below the eyes, including the nose, mouth, cheeks, chin and neck of the wearer. A scarf, added to the mask, has also protected the wearer's neck and is generally devised to slide within the collar of the wearer's coat so that cold air does not enter between the coat and the mask. In addition, for very cold and windy conditions, it is often desired to cover the wearer's entire head to provide additional insulative properties while leaving the wearer's eyes free, generally so that a pair of ski or snowboarding goggles can be worn covering eyes and allowing good visibility while preventing the cold air from contacting the eyes.

However, there is a need for variability of protection of the wearer's head, depending upon the conditions at the time and the type of other headgear that the user may be wearing. In some situations the weather is particularly cold and uncomfortable such that a full head covering, requiring a balaclava is necessary. In other cases the temperature and wind chill factors are not so unpleasant as to require coverage of the entire head, but still cold enough to make coverage of the nose and mouth important, particularly where direct contact with the cold air creates breathing problems. In addition, as more skiers and snowboarders wear crash helmets to protect their heads as they ski or snowboard, there is also a need on occasion for some protective insulative and a vibration reducing layer between the helmet and the wearer's head. Again, in other situations where a skier or snowboarder is wearing a traditional wool or baseball cap on his or her head, the balaclava head covering could interfere with the comfortable fitting of the hats. Thus, there is a need for a head covering which can cover the user's lower face and neck and, when desired, also cover the wearer's upper and back head regions without the need for multiple articles of clothing. Accordingly, there is a need for a convertible head covering which can easily and conveniently shift from a full head covering to a mask and scarf arrangement, without additional parts required or to be removed.

SUMMARY OF THE INVENTION

The invention is generally directed to a convertible head covering including a face mask adjustable in size to cover the wearer's face, below the eyes, and cheeks with a balaclava secured to an upper surface of the mask for covering the remaining portion of the wearer's head, other than the area around the eyes, the balaclava being movable between a deployed position in which it is adapted to cover the wearer's head and a stowed position in which the balaclava portion is hidden within the mask portion.

Another object of the invention is to provide an improved combination of balaclava and face mask which is versatile so that it can be used as a fully adjustable mask and loosened and tightened through the use of Velcro®.

A further object of the invention is to provide an improved combination balaclava and face mask convertible from a face mask to a face mask and balaclava without adding or removing any parts.

Still a further object of the invention is to provide an improved combination balaclava and face mask in which the balaclava headpiece is a thin, wind-proof material which can serve as a helmet liner or a wind-proof liner under a hat.

Yet still another object of the invention is to provide an improved combination balaclava and face mask in which the balaclava component can be folded up and stowed in a resting position inside a pocket within the cheek portion of the face mask.

Still yet another object of the invention is to provide an improved combination balaclava and face mask arrangement in which the balaclava can be easily deployed or stowed dependent upon the ambient conditions.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
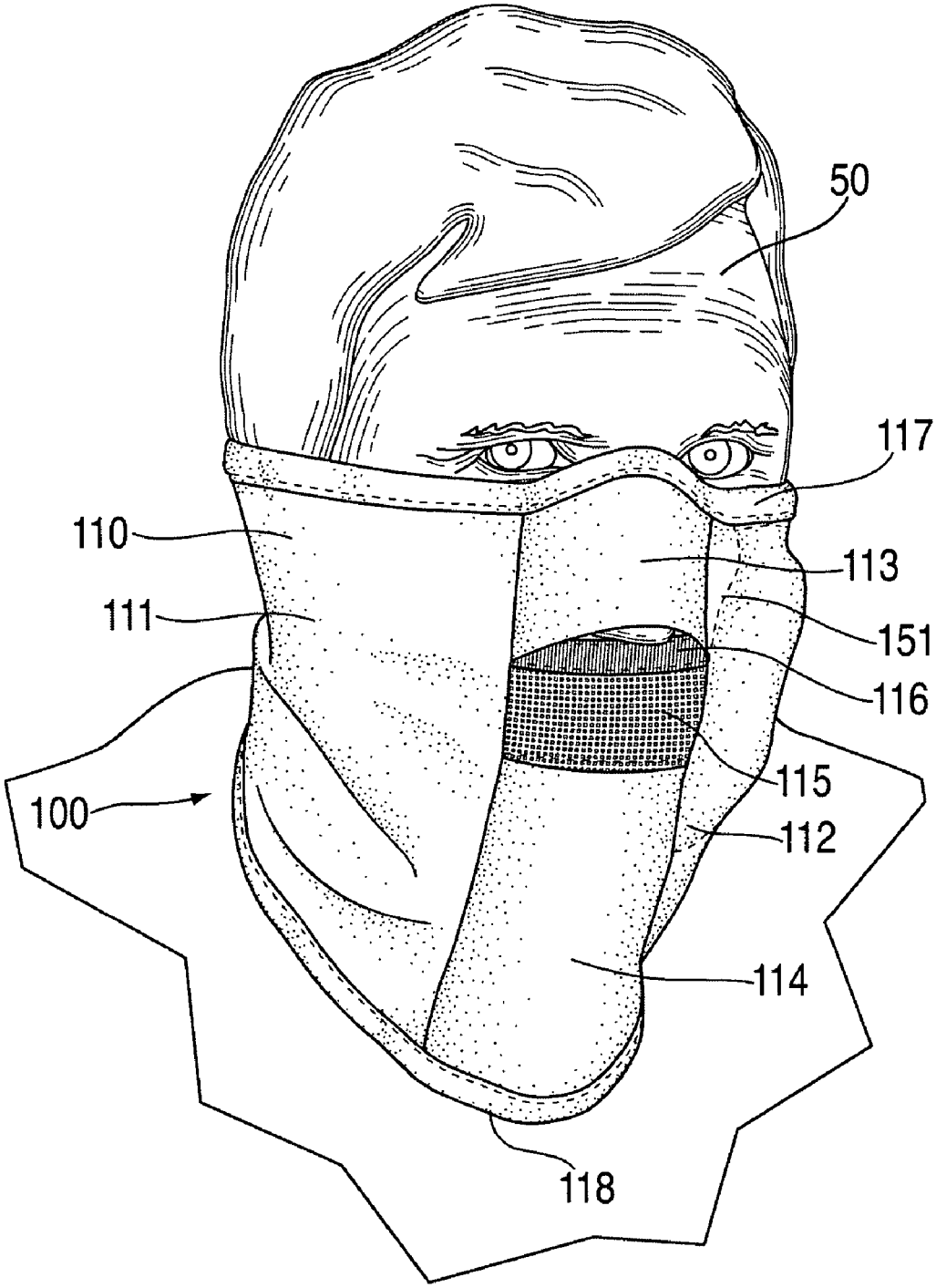
FIG. 2 is a perspective view of the combination of the balaclava and face mask of FIG. 1 in which the balaclava is stowed in the interior pocket.
Figure 3A:
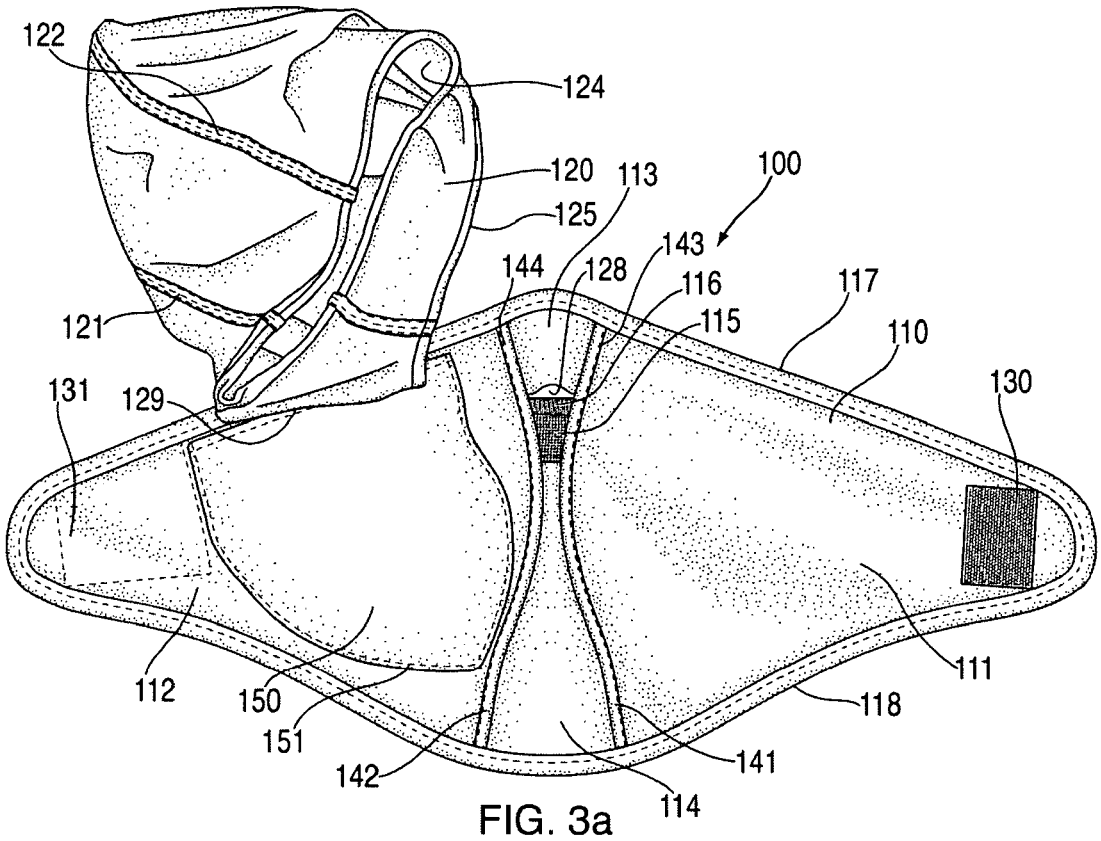
FIG. 3*a* is a top plan view of the inner surface of the balaclava and face mask of FIG. 1 in which the balaclava is removed from the pocket.
Figure 3B:
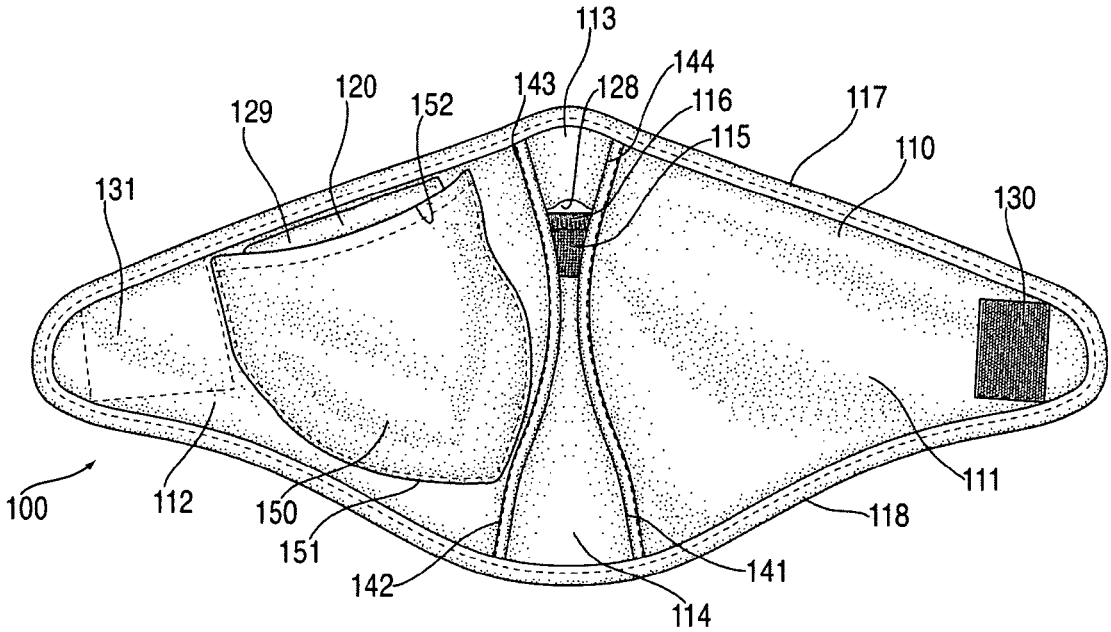
FIG. 3*b* is a similar top plan view to that of FIG. 3*a* in which the balaclava is folded and inserted in the pocket.
Figure 4:
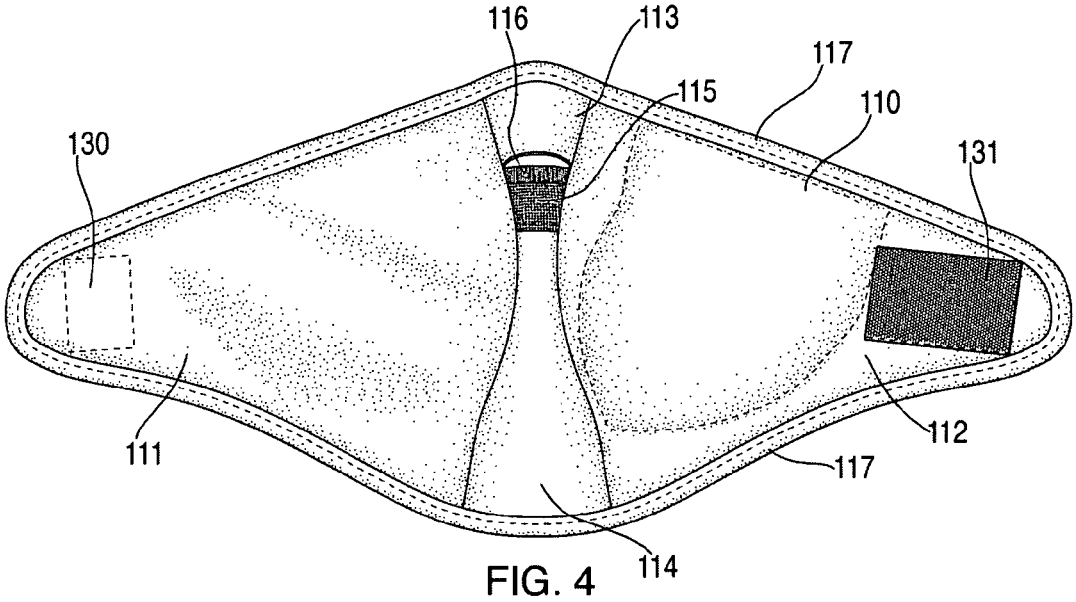
FIG. 4 is a top plan view of the outer surface of the combination of the balaclava and face mask of FIG. 1.

Reference is made to FIGS. 1–4 in connection with the construction of a convertible combination balaclava and face mask, generally indicated as 100, constructed in accordance with a preferred embodiment of the invention. The combination balaclava and face mask 100 includes, generally, a mask portion 110, which generally covers the lower portion of the wearer's face below the eyes and the cheeks and neck and a balaclava portion 120 which covers the remaining portions of the wearer's head except for the area around the wearer's eyes. Generally, this open area of face including the eyes 125 is sized so as to fit within traditional ski or snowboarding goggles so that, when wearing the combination balaclava and face mask 100 and a pair of goggles (not shown) the entire head and neck of the wearer are covered and protected against the cold and wind. As best seen in FIGS. 3*a*, 3*b* and 4, the mask component includes two wing-like sections 111 and 112 which are designed to fit around the sides of the wearer's face and join in the back of the head with mating hook and pad connectors 130, 131. These hook and pad connectors 130, 131 are sized and spaced so as to allow a certain degree of flexibility in adjusting the length of the mask around the wearer's head to fit people with different sized heads and adjust the degree of snugness of the mask. Of course, different size mask and balaclava assemblies can be made to fit a broader range of head sizes.

In addition to the wing pieces 111 and 112, there is a central nose covering flap 113, a lower central panel 114, a mouth mesh 115 and a lower nose section 116. These panels are sewn in place between wing members 111 and 112, along ridges 141 and 142 with stitched seams 143 and 144. Ridges 141 and 142 are built up in a fashion such that a channel between the nose piece 113 and the bottom the mask is achieved which allows for easier breathing and also an insulative column of air against the wearer's face. Generally, ridges 141 and 142 are built up so as to allow a small clearance between the user's skin and the mask so that the mouth portion 115 does not rub against the wearer's lips and tongue in normal conditions. These components are held together by stitching and an outer finishing piping shown as 117 at the top and 118 at the bottom, which provides a finished look and appearance to the mask 110. Other means of attaching the three main components of the mask 110 to each other may be used including glueing, heat sealing, ultrasonic sealing and the like. The connection of the central components along ridges 141 and 142 also acts to stabilize these elements and maintain them in alignment.

In addition, as seen in FIGS. 3*a* and 3*b*, there is a pocket piece 150 with stitching 151 on the cheek portion of the mask 110 forming a pocket 152 which is adapted to stow or hold balaclava 120. As shown in FIGS. 3*a* and 3*b*, balaclava 120 is sewn along a seam 129 at the top surface of wing 112, proximate pocket 152 to wing 112. Alternatively, the balaclava 120 could be reasonably connected to the mesh 110 with a zipper, or one or more buttons, Velcro® pads or other removable closure mechanism. In the current preferred embodiment the balaclava 120 is permanently secured to the mask portion 110 so that there is less likelihood of losing the balaclava portion and a certainty, that when needed the balaclava will be in the pocket 152, ready to be deployed without the need to fumble to locate it or secure it to the mask portion 110.

When folded up, the balaclava 120, which is generally a thin, stretchy material which is either a wind-proof or non-wind-proof material, can fit within pocket 152 on one cheek of the mask 110. For convenience the pocket is shown on the left cheek of the mask 112, but it could as easily be placed on the right cheek. Balaclava 122 is generally shaped to fit a wearer's head and, in a current preferred embodiment, is assembled including two seams, 121 and 122, and has two openings, 124 and 125. Opening 124 is designed to fit around the wearer's head at the lower reach of the balaclava and opening 125 is the opening designed for the eye region. Where the headpiece or balaclava 120 is intended to be worn as a helmet liner, it can be made of a non-wind-proof material. However, if the balaclava is going to be worn as a wind-proof liner under a hat, it is preferably made of a thin wind-proof material. Any suitable, relatively stretchy woven or non-woven, wicking or non-wicking, natural or synthetic materials can be used, depending upon the specific need. However, it is important that the material utilized be sufficiently thin that, when folded up and placed in pocket 152, the material does not create too significant of a bulge at the wearer's cheek. The headpiece 120 is shown as a balaclava, but, depending on the intended use, a less covering headpiece 120 or a more fully covering headpiece 120 can be used. Where the headpiece 120 is intended as a helmet liner and the helmet has a face mask, the balaclava can have an open face and just be a cap. However, if the balaclava will be worn only with sunglasses or other small eyewear, the only openings would be small eye slits or openings. In any of these cases the headpiece 120 would fit within the pocket 152. Generally, the bottom surface of the headpiece 120 extends below the upper edge of the mask 110 so that there is no gap through which the wind and any precipitation could contact the wearer's skin.

Figure 1:
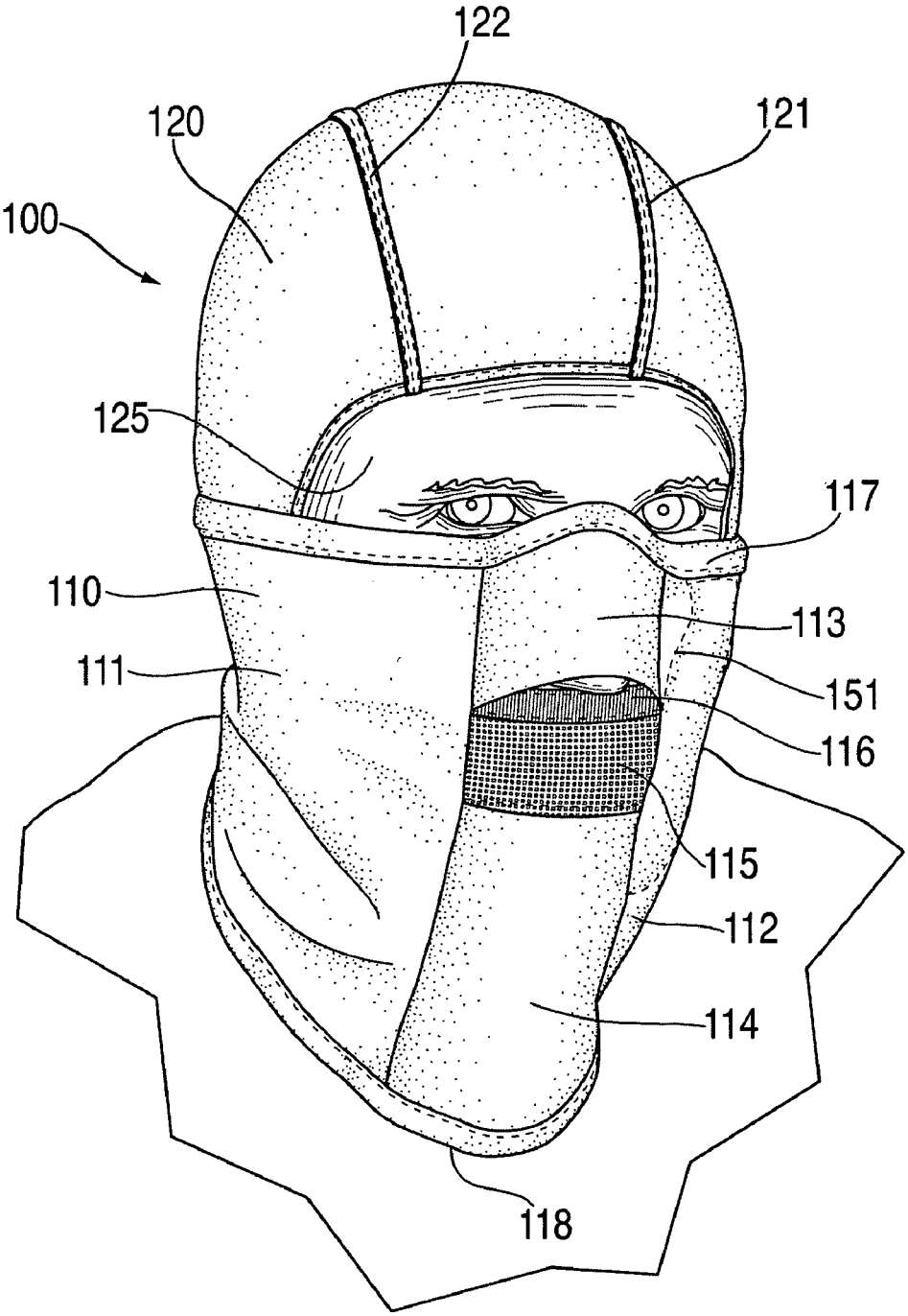
FIG. 1 is a perspective view of the combination of the balaclava and face mask in accordance with the invention in which the balaclava and face mask are deployed on the wearer's head.

FIG. 1 shows the combination balaclava and face mask deployed on the wearer's head with both the balaclava and the face mask in place. FIG. 2 shows the combination balaclava and face mask deployed on the wearer's face without the balaclava covering the wearer's head and, instead, deployed in pocket 152. In practice, a wearer could deploy the balaclava while wearing the mask if conditions change or require the additional warmth or coverage on a rush basis. Generally, to take off the balaclava and stow it in the pocket 152, the wearer would have to remove the mask from his or her face, take off the balaclava portion 120 and fold or otherwise crumple it into pocket 152, before reattaching the mask 110. In other embodiments a small closure can be put at the end of the pocket to seal the opening, but is not required in all applications. The small closure could be a pair of mating hook and pad connectors (like closures 130 and 131 in FIG. 3A) or a button or zipper. However, in a current preferred embodiment there is no need for the closure because the opening at the top of pocket 152 is held closed when the mask is worn.

Figure 5:
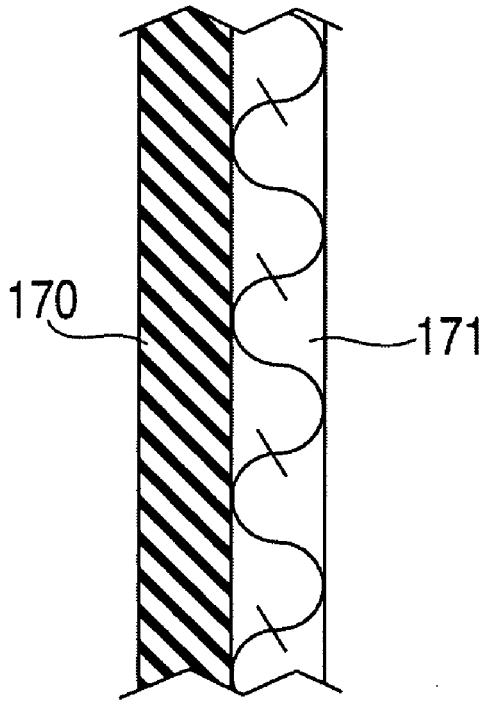
FIG. 5 is a cross-sectional view of the mask portion of the embodiment of FIG. 1.
Figure 6:
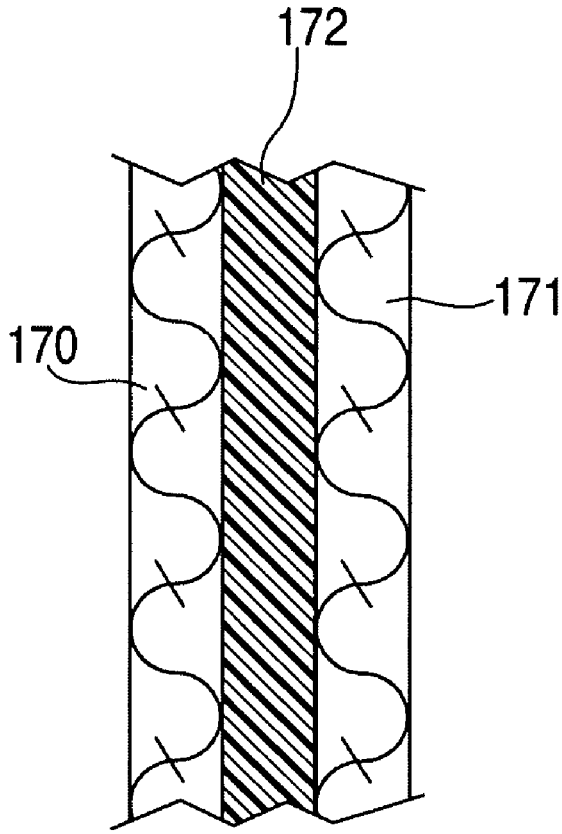
FIG. 6 is a cross-sectional view of the mask portion in accordance with another embodiment of the invention.

Reference is made to FIGS. 5 and 6 wherein cross-sectional views of wing sections 111 or 112 are shown in accordance with two preferred embodiments of the invention. In a first preferred embodiment of the invention shown in FIG. 5, the wing components 111 and 112, as well as the nose covering layer 113 and lower central section 114, are formed as a two-layer laminate including highly breathable stretch woven fabric 171, laminated to a one-sided fleece 170. In the case of a three-layer laminate as shown in FIG. 6, the stretch woven layer 171 has a wind-proof/breathable film 172 and one-sided fleece 170 in a sandwich arrangement with the wind-proof/breathable film 172 as the middle layer. The fleece 170 is generally a performance fabric which reduces the relative humidity next to the wearer's skin by dispersing the moisture throughout the surface area of the fabric. To the extent that the wind-proof/breathable film 172 is utilized, the moisture is able to migrate away from the wearer's face and the fleece layer in contact with the wearer's skin.

The layer 115 covering the wearer's mouth area is generally formed as a thin, open-weave mesh layer which allows for the wearer to breathe through the mouth without substantial resistance but still providing protection against the wind and cold air contacting the mouth. Layer 116 at the top of the mouth area 115 and below the gap 128 between nose flap 113 and member 116 is formed as a more ridged mesh member which provides some flow of air but provides more structural rigidity than the mesh 115. Nose flap portion 113 is configured so that it has additional material beyond the necessary distance between ridges 141 and 142 in these regions so that it provides a tent-like cover over the wearer's nose so that the mask does not press strongly against the wearer's nose.

In use, the wearer, when going out for a day of skiing, snowboarding or other cold weather outdoor activity, would determine whether they wish to wear just the mask portion 110 of the combination mask and balaclava headgear 100 or the fully deployed mask and balaclava. In the event that only the mask is desired, the wearer would merely place the mask properly over the wearer's face, centering and locating the nose and mouth openings in the correct spots, and then adjusting the fit and pressing hook and pile connectors 130 and 131 against each other in the appropriate location at the back of the wearer's head. However, if the wearer decides, either initially or subsequently, that he or she requires the full mask and balaclava, he or she merely removes the balaclava 120 from pocket 152 and slides the wearer's head through opening 124, centering opening 125 about the wearer's head, before closing mask portion 110 about the wearer's head as above. When the mask is closed, it also encircles the bottom of the balaclava, so that there is a complete covering of the head except for the opening in the front of the balaclava around the eyes. If, during the course of wearing the mask, the user determines that he or she wants to add the balaclava portion; such as, when sitting on a cold and windy ski lift; the balaclava 120 can be easily removed from pocket 152 and slipped over the wearer's head either without removing the mask 110 or more normally by taking off the mask and then easily deploying the balaclava 120, putting it on the head and finally securing the mask portion 110 in place.

Figure 7:
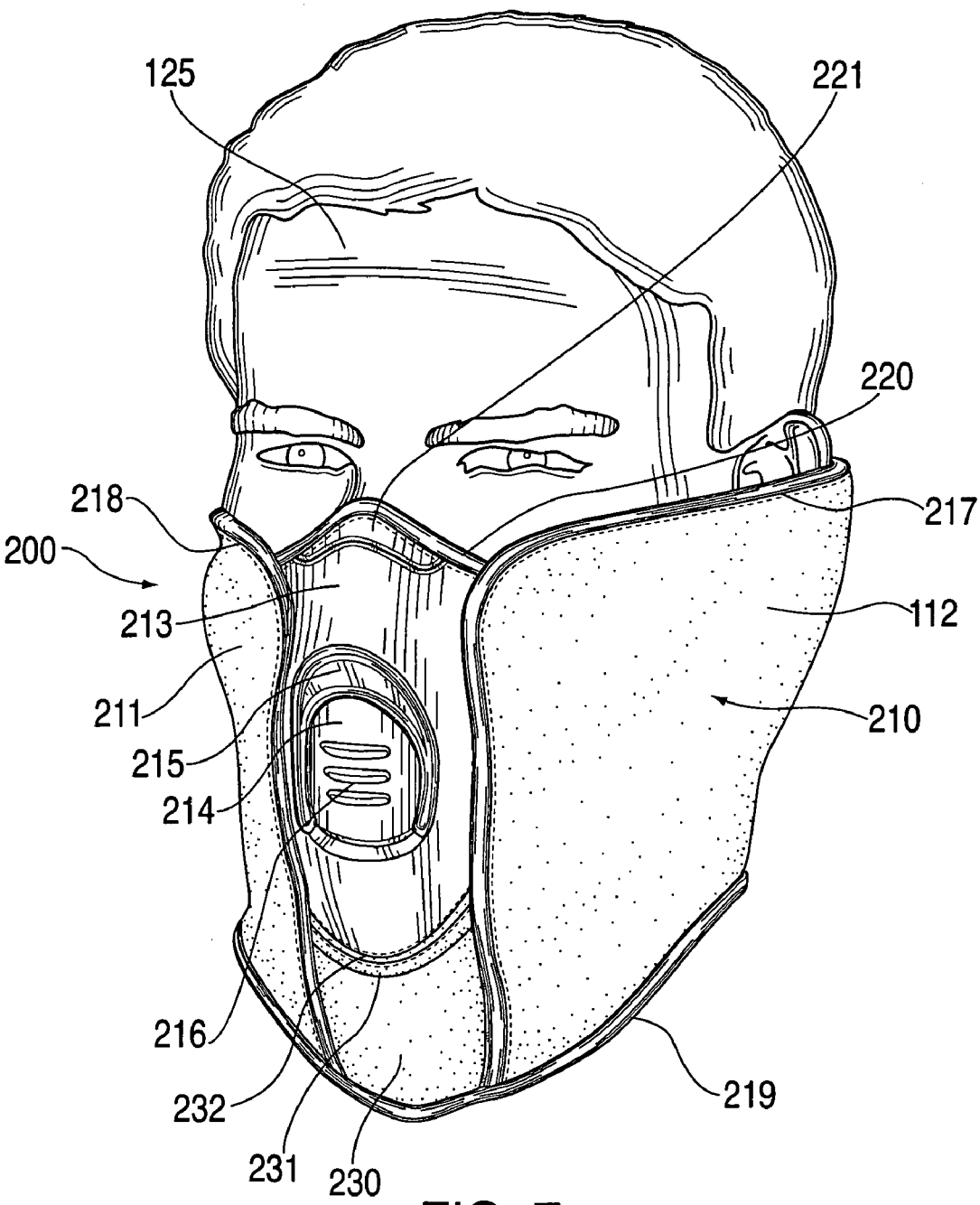
FIG. 7 is a perspective view of an enhanced mask system constructed in accordance with a preferred embodiment of the invention with the balaclava in the secured position.

Reference is next made to FIG. 7 wherein a combination mask and headgear, generally indicated as 200, constructed in accordance with a current preferred embodiment of the invention is depicted, like elements represented by like reference numerals. Generally, combination mask 200 is generally similar to combination 100 described above except for the central section of the mask including mouth and nose piece 213 and lower central piece 230, which provide an access opening about the wearer's mouth formed with flap 214, creating opening 215 and having slits 216. In a current preferred embodiment of the invention the mouth and nose piece 213 is formed using a compression molded foam that sits between panels 111, 112 which in turn are secured around the back of the wearer's head with mating hook and pile pads 130, 131 (shown in FIGS. 3A and 3B). The mouth and nose piece 213 has a low density flange that wraps around the contour of piece 213 so that it can be easily sewn to panels 111 and 112 without creating uncomfortable seams. Mouth and nose piece 213 has an additional molded component 214 that is in the mouth area, which acts as a panel that can be opened and closed. The small foam panel would detach from a mating hook and pile landing at the upper extremity of the panel and be hinged to the foam piece 213 on the lower extremity. This hinge is created as part of the actual mold and is subsequently die cut on three sides (with the fourth side remaining attached and acting as the hinge). This allows the piece to open and close, with the hook and pile pads acting as a way to maintain the small panel 214 to remain closed when desired. The foam pad 214 which acts as the door is ventilated with horizontal perforations 216, so that when the door 214 is closed and resting on its Velcro landing the wearer can still have sufficient ventilation. When wearer opens the panel 214 it optimizes the ventilation and breathability. It also serves a variety of other purposes. Hydration is popular in winter cardiovascular sports, including Nordic and Alpine skiing, snowshoeing, running, mountain biking and others. By having the selectively openable panel function, this allows the wearer to easily hydrate by having full access for a hydration tube to enter the wearer's mouth without having to remove the mask. In addition, hunters will be able to blow duck calls while wearing a face mask without having to take off the face mask. Also, when ski goggles fog up due to condensation created by a face mask rising into the lens area, the wearer can open the mouth piece panel 214 for full breathability and to disperse the condensation which causes the fogging up.

As seen in FIG. 7, the mask combination 200 includes side panels 111 and 112 which have piping and sewn seams 217, 218 around the tops and along the border with central sections 213 and 230 in the middle, and a bottom piping and sewn seam 219 which secures side panels 111, 112 to bottom section 230 and forms a clean bottom. In addition, there is a piping 231 and seam 232 between bottom section 230 and nose and mouth section 213. Generally, a flange (not shown) extends beyond the bottom of the face of section 213 to form a clean and smooth connection. Generally, bottom section 230 can be made of the same materials as side panels 111 and 112. There is a piping 220 at the top of section 213 to form a clean and smooth edge for this tender contact point and a seam 221. This section of nose and mouth section 213 is formed in a tent shape so that it fits the wearer's nose without exerting undue pressure on the bridge of the wearer's nose. In a current preferred embodiment, the nose and mouth portion 213 is formed as a compression molded foam laminated as a sandwich between a woven fabric on the outside, which provides some wind resistance and a soft moisture management fabric on the interior, such as a fleece. This sandwich arrangement would look like the sandwich shown in FIG. 6, with the foam being like layer 172 and the woven fabric being 170 and the fleece 171. The compression molded foam assures that the sandwich arrangement retains the molded shape.

Figure 8:
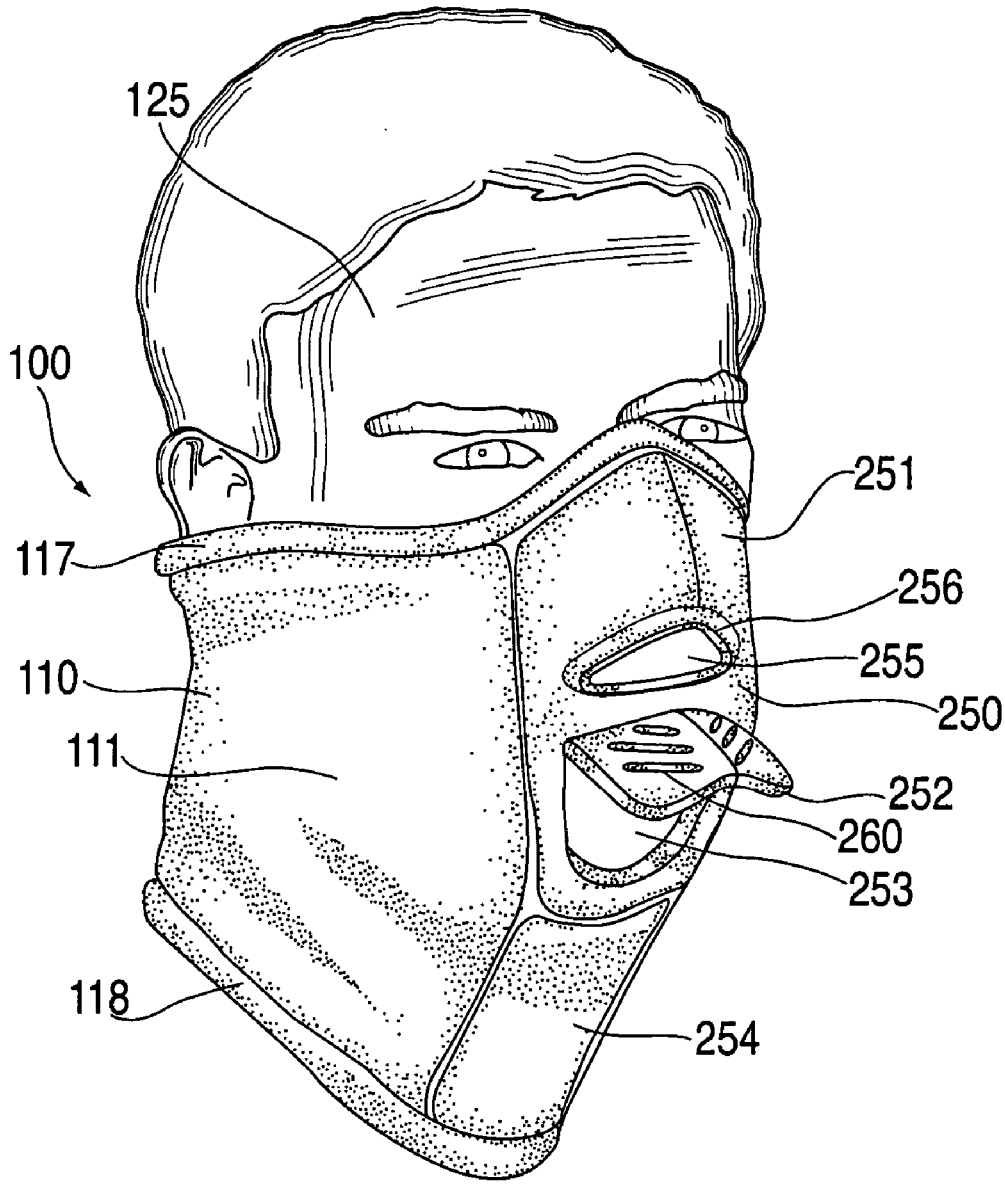
FIG. 8 is a perspective view of an enhanced mask system constructed in accordance with another preferred embodiment of the invention with the balaclava in the secured position.

Reference is next made to FIG. 8 which shows another mask combination 300 in accordance with another preferred embodiment of the invention, like elements represented by like reference numerals. The major difference between the embodiment of FIG. 7 and FIG. 8 is that there is an opening for the nostrils 255 surrounded by a frame 256. There can be a mesh in the opening 255, or a open weaved fabric, but an opening can also be used. The next difference is that the flap 252 which fills opening 253, either completely or with a small margin around flap 252, opens from the bottom up rather than from the top down as in the embodiment of FIG. 7. The flap 252 includes perforations 260. The bottom section 254 is essentially the same as bottom section 230 in the embodiment of FIG. 7.

In each of the embodiments of FIGS. 7 and 8, the pocket is formed on the inside of the mask portion which is adapted to hold the balaclava or other head covering piece when it is not being deployed on the wearer's head. Generally, the head covering piece or balaclava are made of a very thin material so that when folded and stowed in the pouch it doesn't cause a large bulge in the mask portion, as shown in FIG. 2, in panel 112.

Other types of hats or balaclavas can be used with the mask system, to cover more or less of the wearer's head and face, depending on the use intended. In addition, depending on whether the balaclava will be the outside layer, or merely a liner for a helmet or some other covering, the characteristics of the material used can be modified.

Accordingly, an improved combination mask and balaclava which is sufficiently versatile so that it can be a fully adjustable mask and have a deployable and stowable balaclava included therein is provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. An enhanced mask system, comprising:

a mask portion, for covering the nose, mouth and lower face of a wearer, the mask portion having an inner surface for being closer to the wearer and an outer surface for being further from the wearer;

a head covering or balaclava secured to the mask portion; and stowing means, secured to the inner surface of the mask portion for removably containing the head covering or balaclava when in its secured position;

whereby the mask can be worn by the wearer either with the head covering or balaclava on the wearer's head in a deployed position or without the head covering or balaclava on the wearer's head and stowed in the stowing means in the secured position.

2. The enhanced mask system of claim 1 wherein the stowing means is a pouch attached to the inner surface of the mask portion.

3. The enhanced mask system of claim 2 wherein the pouch has an open end for stowing or deploying the head covering or balaclava.

4. The enhanced mask system of claim 1 wherein the mask portion includes a central portion and two wing portions.

5. The enhanced mask system of claim 4 wherein the wing portions include mating connectors to secure the wing portions to each other and retain the mask portion around the wearer's face.

6. The enhanced mask system of claim 4 wherein the central portion includes a selectively openable section for maintaining direct access through the central portion of the mask proximate the mouth.

7. The enhanced mask system of claim 6 wherein the openable section is an integrally formed flap with a hinge.

8. The enhanced mask system of claim 1 wherein the head covering or balaclava is a balaclava intended to cover the wearer's entire head, beyond the portion already covered by the mask portion, aside from an area around the eyes.

9. The enhanced mask system of claim 8 wherein the area around the eyes is smaller than the area of an eye covering to be worn with the enhanced mask system.

10. The enhanced mask system of claim 1 wherein the mask portion includes a central portion covering the nose, mouth and chin of the wearer's face and two wing portions secured to the central portion.

11. The enhanced mask system of claim 10 wherein the central portion includes a compressed foam layer sandwiched between an outer and an inner fabric.

12. The enhanced mask system of claim 11 wherein the outer and inner fabrics are designed to be weather resistant on the outer surface and comfortable against the wearer's face on the inner surface.

13. The enhanced mask system of claim 10 wherein the inner fabric is a fleece.

14. The enhanced mask system of claim 10 wherein the central portion is sewn to the wing portions.

15. The enhanced mask system of claim 1 wherein the head piece or balaclava is formed as a thin layer which acts as a liner for a helmet.

* * * * *